US006161091A

United States Patent [19]

Akamine et al.

[11] Patent Number: 6,161,091

[45] Date of Patent: Dec. 12, 2000

[54] SPEECH RECOGNITION-SYNTHESIS BASED ENCODING/DECODING METHOD, AND SPEECH ENCODING/DECODING SYSTEM

[75] Inventors: Masami Akamine; Ryosuke Koshiba, both of Kobe, Japan

[73] Assignee: Kabushiki Kaisha Toshiba, Kawasaki, Japan

[21] Appl. No.: 09/042,612

[22] Filed: Mar. 17, 1998

[30] Foreign Application Priority Data

Mar. 18, 1997 [JP] Japan ..... 9-064933

[51] Int. Cl.[7] ..... G10L 13/00

[52] U.S. Cl. ..... 704/258; 704/207; 704/260; 704/256; 704/264

[58] Field of Search ..... 704/214, 208, 704/260, 201, 270, 275, 256, 207, 258, 257, 264

[56] References Cited

U.S. PATENT DOCUMENTS

| | | | |
|---|---|---|---|
| 3,704,345 | 11/1972 | Coker | 704/260 |
| 4,797,930 | 1/1989 | Goudie | 704/258 |
| 4,799,261 | 1/1989 | Lin et al. | 704/260 |
| 4,802,223 | 1/1989 | Lin et al. | 704/258 |
| 4,868,867 | 9/1989 | Davidson et al. | 704/207 |
| 4,912,768 | 3/1990 | Benbassat | 704/260 |
| 4,964,167 | 10/1990 | Kunizawa et al. | 704/260 |
| 5,230,037 | 7/1993 | Guistiniani et al. | 704/256 |
| 5,384,893 | 1/1995 | Hutchins | 704/258 |
| 5,617,507 | 4/1997 | Lee et al. | 704/201 |
| 5,636,325 | 6/1997 | Farrett | 704/258 |
| 5,649,056 | 7/1997 | Nitta | 704/256 |
| 5,682,501 | 10/1997 | Sharman | 704/260 |
| 5,704,009 | 12/1997 | Cline et al. | 704/275 |
| 5,732,395 | 3/1998 | Alexander Silverman | 704/260 |
| 5,774,854 | 6/1998 | Sharman | 704/260 |
| 5,860,064 | 1/1999 | Henton | 704/260 |
| 5,870,709 | 2/1999 | Bernstein | 704/275 |

FOREIGN PATENT DOCUMENTS 5-76040 10/1993 Japan .

*Primary Examiner*—Tālivaldis I. Smits
*Assistant Examiner*—Vijay Chawan
*Attorney, Agent, or Firm*—Oblon, Spivak, McClelland, Maier & Neustadt, P.C.

[57] ABSTRACT

A speech recognition synthesis based encoding/decoding method recognizes phonetic segments, syllables, words or the like as character information from an input speech signal and detects pitch periods, phoneme or syllable durations or the like, as information for prosody generation, from the input speech signal, transfers or stores the character information and information for prosody generation as code data, decodes the transferred or stored code data to acquire the character information and information for prosody generation, and synthesizes the acquired character information and information for prosody generation to obtain a speech signal.

26 Claims, 11 Drawing Sheets

SPEECH RECOGNITION-SYNTHESIS BASED ENCODING/DECODING METHOD, AND SPEECH ENCODING/DECODING SYSTEM

BACKGROUND OF THE INVENTION

1. Field of the Invention

The present invention relates to a method and system for encoding and decoding speech signals at a low-bit rate with a high efficiency, and, more particularly, to a speech recognition-synthesis based encoding method of encoding speech signals at a very low-bit rate of 1 kbps or lower, and a speech encoding/decoding method and system which use the speech recognition-synthesis based encoding method.

2. Discussion of the Background

Techniques of encoding speech signals with a high efficiency are now essential in mobile communication which has a limited available radio wave band and storage media like a voice mail which demands efficient memory usage, and are being improved to seek lower bit rates. CELP (Code Excited Linear Prediction) is one of effective schemes of encoding speech of a telephone band at a transfer rate of about 4 kbps to 8 kbps.

This CELP system is specifically discussed in "Code Excited Linear Prediction (CELP): High Quality Speech at Very Low Bit Rates" by M. R. Schroeder and B. S. Atal, Proc. ICASSP, pp. 937–940, 1985, and "Improved Speech Quality and Efficient Vector Quantization in SELP" by W. S. Kleijin, D. J. Krasinski et al., Proc. ICASSP, pp. 155–158, 1998 (Document 1).

This document 1 shows that this system is separated to a process of acquiring a speech synthesis filter which is a model of a vocal tract from an input speech divided frame by frame, and a process of obtaining excitation vectors which are input signals to this filter. The second process passes a plurality of excitation vectors, stored in a codebook, through the speech synthesis filter one by one, computes distortion between the synthesized speech and the input speech, and finds the excitation vector which minimizes this distortion. This process is called closed loop search, which is very effective in reproducing a good speech quality at a bit rate of as low as 4 kbps to 8 kbps.

An LPC vocoder is known as a scheme of encoding speech signals at a lower bit rate. The LPC vocoder provides a model of a vocal signal with a pulse train and a white noise sequence and a model of a vocal characteristic by an LPC synthesis filter, and encodes those parameters. This scheme can encode speech signals at a rate of approximately 2.4 kbps at the price of a lower speech quality. Those encoding systems are designed to transfer linguistic information about what a speaker is saying as well as information the original speech waveform has, such as personality, vocal property and feeling, with as high a fidelity as possible perceptually, and are used mainly in telephone-based communications.

Due to the recent popularity of Internet, the number of subscribers who use a service called net chatting is increasing. This service provides real-time chatting of one-to-one, one-to-multiple and multiple-to-multiple on a network, and employs a system which is based on the aforementioned CELP system to transfer speech signals. The CELP system, which has a bit rate lower by ⅛ to 1/16 than that of the PCM system, can ensure efficient transfer of speech signals. But, the number of users who use Internet is rapidly increasing, which often heavily loads a network. This delays the transfer of speech information, and thus interferes with smooth chatting.

A solution to such a situation requires a technique of encoding speech signals at a lower bit rate than that of the CELP system. As an extreme way of encoding at a low bit rate is known recognition-synthesis based encoding which recognizes linguistic information of a speech, transfers a string of characters which represents the linguistic information, and executes rule-based synthesis on the character string on the receiver side. This recognition-synthesis based encoding, which is briefly introduced in "Highly Efficient Speech Encoding" by Kazuo Nakada, Morikita Press (Document 2), is said to be able to transfer speech signals at a very low rate of about several dozens to 100 bps.

The recognition-synthesis based encoding however requires that a speech should be acquired by performing a rule-based synthesis on a character string obtained by the use of a speech recognition scheme. If speech recognition is incomplete, therefore, intonation may become significantly unnatural, or the contents of conversation may be in error. In this respect, the recognition-synthesis based encoding is premised on the complete speech recognition technique, due to which there is no practical recognition-synthesis based encoding implemented yet, and which it seems makes it difficult to realize the encoding system in future too.

Because such a method of carrying out communication after converting speech signals or physical information into linguistic information which is advanced abstract information is difficult to realize, an encoding scheme has been proposed which recognizes speech signals as more physical information and converts the former to the latter. One known example of this scheme is "Vocoder Method And Apparatus" described in Jpn. Pat. Appln. KOKOKU Publication No. Hei 5-76040 (Document 3).

The document 3 describes an analog speech input sent to a speech recognition apparatus and then converted to a phonetic segment stream there. The phonetic segment stream is converted by a phonetic segment/allophone synthesizer to its approximated allophone stream by which a speech is reproduced. In the speech recognition apparatus, an analog speech input is sent to a formant trucker, while its signal gain is kept at a given value by an AGC (Automatic Gain Controller), and a formant in the input signal is detected and stored in a RAM. The stored formant is sent to a phonetic segment boundary detector to be segmented to phonetic components. The phonetic segments is checked against a phonetic segment template for a match by a recognition algorithm, and the recognized phonetic segment is acquired.

In the phonetic segment/allophone synthesizer, an allophone stream corresponding to the input phonetic code is read from a ROM and then sent to a speech synthesizer. The speech synthesizer acquires parameters necessary for speech synthesis, such as the parameter of a linear prediction filter, from the received allophone stream, and acquires a speech through synthesis using those parameters. What is called "allophone" is a speech which is a phonetic segment affixed with an attribute determined in accordance with predetermined rules using phonetic segments around the former one. (The attribute indicates if the phonetic segment is an initial speech, an intermediate speech or an ending speech, or if it is a nasal-voiced or unvoiced.)

The key point of the scheme described in the document 3 is that a speech signal is simply converted to a phonetic symbol string, not to a character string as linguistic information, and the symbol string is associated with physical parameters for speech synthesis. This design brings about such an advantage that even if a phonetic segment is erroneously recognized, a sentence as a whole does not change much though the erroneous phonetic segment is changed to another phonetic segment.

The document 3 describes that because of the natural filtering by human ears and error correction by a listener in the though process, errors which are produced by the recognition algorithm is minimized by acquiring the best matching, if not complete recognition.

Since the encoding method disclosed in the document 3 simply transfers a symbol string representing phonetic segments from the encoding side, a synthesized speech reproduced on the encoding side becomes unnatural without intonation or rhythm, so that the contents of the conversation are merely transmitted but information on the speaker or information on the speaker's feeling will not be transmitted.

In short, those prior arts have the following shortcomings. Because the conventional recognition-synthesis system which recognizes linguistic information of a speech, transfers a character string expressing that information and performs rule-based synthesis on the decoding side is premised on the complete speech recognition technique, it is practically difficult to realize.

Further, the known encoding system, which can employ even an incomplete speech recognition scheme, simply transfers a symbol string representing phonetic segments from the encoding side, a synthesized speech reproduced on the encoding side becomes unnatural without intonation or rhythm, so that the contents of the conversation are merely transmitted but information on the speaker or information on the speaker's feeling will not be transmitted.

SUMMARY OF THE INVENTION

Accordingly, it is an object of the present invention to provide a recognition synthesis based encoding/decoding method and system, which can employ even an incomplete speech recognition scheme to encode speech signals at a very low rate of 1 kbps or lower, and can transfer non-linguistic information such as speaker's feeling.

A speech recognition synthesis based encoding/decoding method according to this invention recognizes phonetic segments, syllables or words as character information from an input speech signal, detects pitch periods and durations of the phonetic segments or syllables, as information for prosody generation, from the input speech signal, transfers or stores the character information and information for prosody generation as code data, decodes the transferred or stored code data to acquire the character information and information for prosody generation, and synthesizes the acquired character information and information for prosody generation to obtain a speech signal.

A speech encoding/decoding system according to this invention comprises a recognition section for recognizing character information from an input speech signal; a detection section for detecting information for prosody generation from the input speech signal; an encoding section for encoding the character information and information for prosody generation; a transfer/storage section for transferring or storing code data acquired by the encoding section; a decoding section for decoding the transferred or stored code data to acquire the character information and information for prosody generation; and a synthesis section for synthesizing the acquired character information and information for prosody generation to obtain a speech signal.

More specifically, the recognition section recognizes phonetic segments, syllables or words as character information from an input speech signal and detects the duration of the recognized character information and the pitch period of the input speech signal as information for prosody generation.

In this invention, as apparent from the above, in addition to recognition of character information, such as phonetic segments, syllables or words, from an input speech signal and transfer or storage of that information on the encoding side (transmission side), information for prosody generation, such as a pitch period or a duration is detected from the input speech signal and this information is also transferred or stored, and a speech signal is acquired based on the transferred or stored character information, such as phonetic segments or syllables, and the transferred or stored information for prosody generation like a pitch period or a duration, on the encoding side (reception side). This can ensure encoding of speech signals at a very low rate of 1 kbps or lower, and reproduction of speaker's intonation and rhythm or tone. It is thus possible to transfer non-linguistic information such as speaker's feeling, which conventionally was difficult.

According to this invention, a plurality of synthesis unit codebooks, which have been generated from speech data of different speakers and have stored information on synthesis units for use in acquisition of the speech signal, may be prepared so that one of the synthesis unit codebooks is selected in accordance with the information for prosody generation to thereby acquire the speech signal. With this design, a synthesized speech more similar to a speech signal, input on the encoding side (transmission side), is reproduced on the decoding side (reception side).

Further, one of the aforementioned synthesis unit codebooks may be selected in accordance with a specified type of a synthesized speech. This allows the type of a to-be-synthesized speech signal to be specified by a user on the transmission side or the reception side, so that the vocal property can be changed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
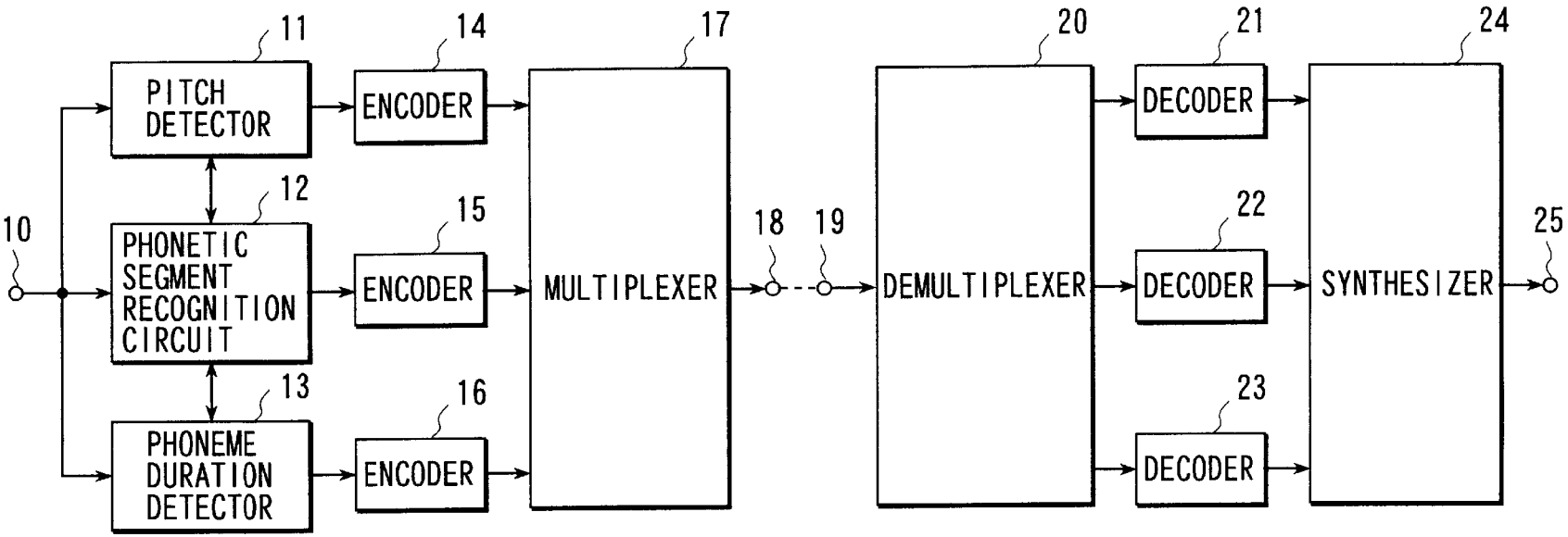
FIG. 1 is a block diagram of a speech encoding/decoding system according to a first embodiment of this invention.

As shown in FIG. 1, a speech encoding/decoding system comprises a pitch detector 11, a phonetic segment recognition circuit 12, a phoneme duration detector 13, encoders 14, 15 and 16, a multiplexer 17, a demultiplexer 20, decoders 21, 22 and 23, and a synthesizer 24.

On the encoding side (transmission side), a digital speech signal (hereinafter called input speech data) is input from a speech input terminal 10. This input speech data is sent to the pitch detector 11, the phonetic segment recognition circuit 12 and the phoneme duration detector 13. The result of detection by the pitch detector 11, the result of recognition by the phonetic segment recognition circuit 12 and the result of detection by the phoneme duration detector 13 are respectively encoded by the encoders 14, 15 and 16, and then multiplexed to become a code stream by the multiplexer 17 as a code multiplexing section. The code stream is transferred to a communication path from an output terminal 18.

On the decoding side (reception side), the demultiplexer 20 as a code separation section separates the code stream, transferred through the communication path from the encoding side (transmission side), into a code of a pitch period, a code of a phonetic segment and a code of a duration, which are in turn input to the decoders 21, 22 and 23 to acquire original data. Those decoded data are synthesized by the synthesizer 24, and a synthesized speech signal (decoded speech signal) is output from an output terminal 25.

The individual components in FIG. 1 will now be discussed in detail.

The phonetic segment recognition circuit 12 identifies character information, included in the input speech data from the speech input terminal 10, for each phonetic segment by using a known recognition algorithm, and sends the identification result to the encoder 14. As the recognition algorithm, various schemes can be used as introduced in, for example, "Sound Communication Engineering" by Nobuhiko Kitawaki, Corona Publishing Co., Ltd. In this specification, a scheme to be discussed below is used as an algorithm which treats phonetic segments as recognition units.

Figure 2:
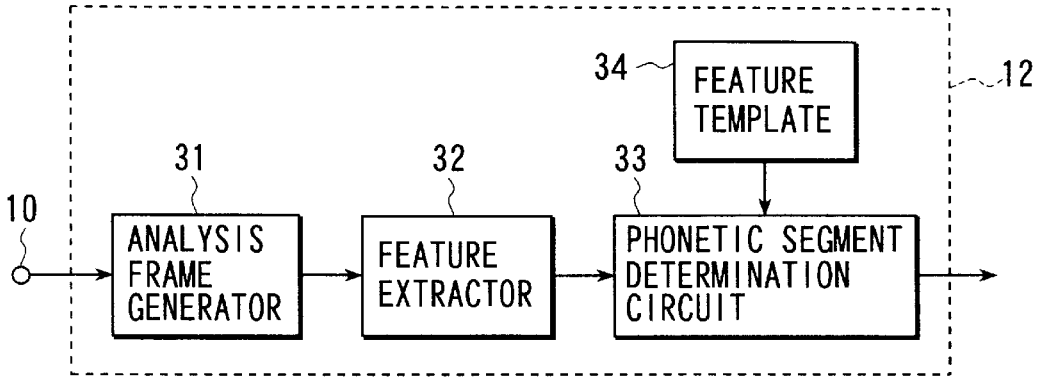
FIG. 2 is a block diagram of a phonetic segment recognition circuit in FIG. 1.

FIG. 2 shows the structure of the phonetic segment recognition circuit 12 which is based on this algorithm. In this phonetic segment recognition circuit 12, input speech data from the speech input terminal 10 is input to an analysis frame generator 31 first. The analysis frame generator 31 divides the input speech data into synthesis frames, multiplies the synthesis frames by a window function to reduce an influence of signal breaking, and then sends the results to a feature extractor 32. The feature extractor 32 computes an LPC cepstrum coefficient for each synthesis frame, and sends this coefficient as a feature vector to a phonetic segment determination circuit 33. The phonetic segment determination circuit 33 computes a Euclidean distance as a similarity between the received feature vector for each synthesis frame and a feature vector for each phonetic segment, previously prepared in a feature template 34, determines a phonetic segment which minimizes this distance as the phonetic segment of the frame, and outputs the determination result.

Although an LPC cepstrum coefficient is used as a feature, a delta cepstrum may be used in addition to improve the recognition accuracy. Instead of treating the LPC cepstrum coefficient of the input synthesis frame as a feature vector, this LPC cepstrum coefficient plus LPC cepstrum coefficients acquired from synthesis frames which have been input at a given time before and after that synthesis frame may be treated as feature vectors to consider a time-dependent variation in LPC cepstrum coefficient. Further, while the Euclidean distance is used as a similarity between feature vectors, an LPC cepstrum distance may be used in consideration of the use of an LPC cepstrum coefficient for a feature vector.

The pitch detector 11 determines if the input speech data from the speech input terminal 10 is a voiced speech or an unvoiced speech in synchronism with the operation of the phonetic segment recognition circuit 12 or at every predetermined unit time, and further detects a pitch period when the speech data is determined as a voiced speech. The result of the voiced speech/unvoiced speech determination and information on the pitch period are sent to the encoder 15, and codes representing the result of the voiced speech/unvoiced speech determination and the pitch period are assigned. A known scheme like an auto-correlation method can be used as an algorithm for the voiced speech/unvoiced speech determination and the detection of the pitch period. In this case, the mutual use of the recognition result from the phonetic segment recognition circuit 12 and the detection result from the pitch detector 11 can improve the precision of phonetic segment recognition and pitch detection.

Figure 3:
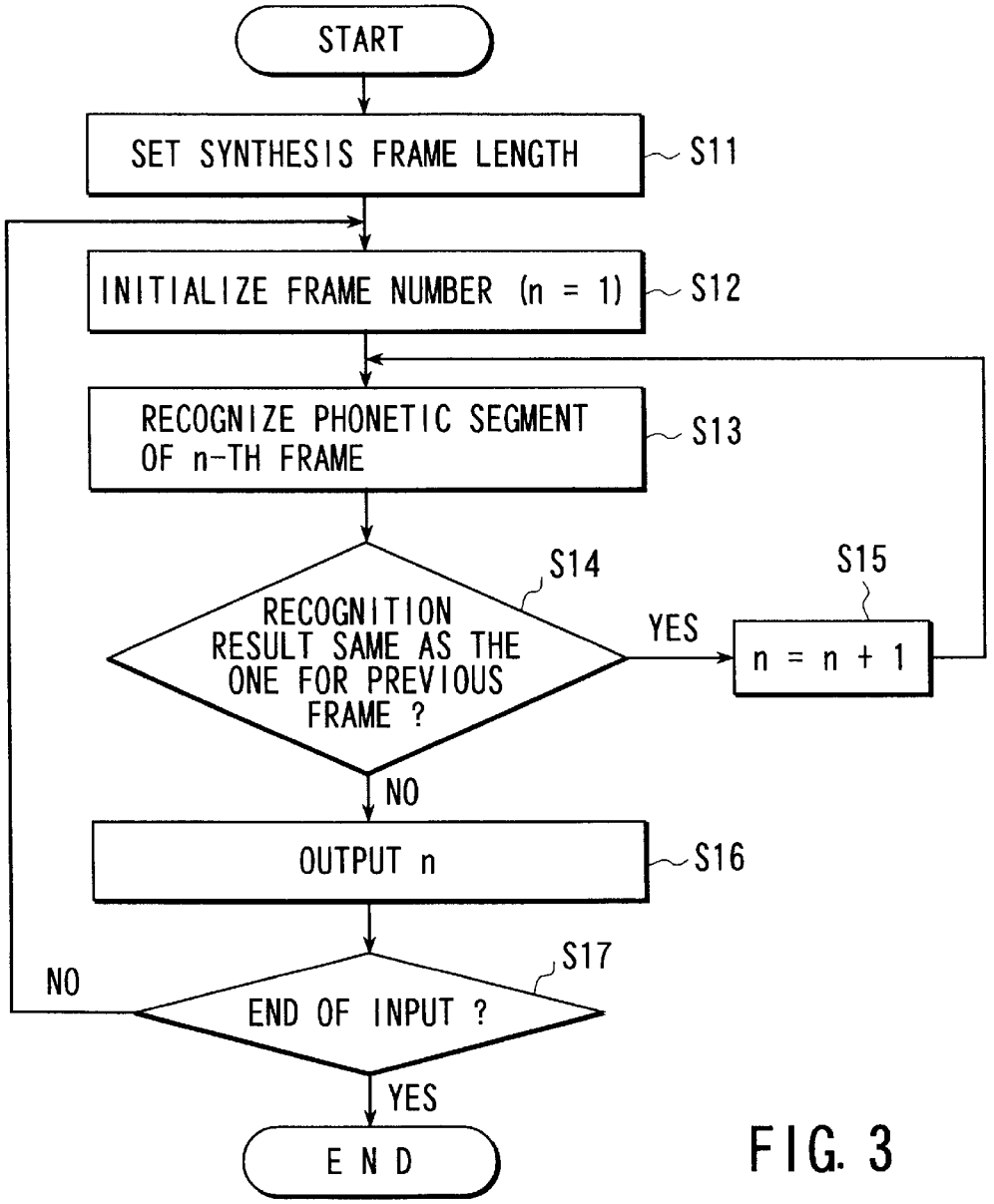
FIG. 3 is a flowchart illustrating a sequence of processes executed by a phoneme duration detector in FIG. 1.

The phoneme duration detector 13 detects the duration of a phonetic segment recognized by the phonetic segment recognition circuit 12 in synchronism with the operation of the phonetic segment recognition circuit 12. Referring to the flowchart illustrated in FIG. 3, one example of how to detect the duration will be described below.

First, a synthesis frame length for executing phonetic segment recognition is set in step S11, and the number of a frame which is subjected to phonetic segment recognition is initialized in step S12. Next, recognition of a phonetic segment is carried out by the phonetic segment recognition circuit 12 in step S13, and it is determined in step S14 if the recognition result is the same as that of the previous frame. When the result of the phonetic segment recognition of the current frame matches with that of the previous frame, the frame number is incremented in step S15 after which the flow returns to step S13. If otherwise, the frame number n is output in step S16. The above-described sequence of processes is repeated until no further input speech data is available.

The phonetic duration detected in this manner is a production of n and the frame length. There may be another scheme for duration detection, which when a phonetic segment is recognized, has previously determined the minimum required time for another phonetic segment to be recognized next since recognition of one phonetic segment, thereby suppressing the output of an actually improbable duration due to erroneous phonetic segment recognition. The detection result from the phoneme duration detector 13 is sent to the encoder 16 and a code representing the duration is assigned.

The outputs of the encoders 14 to 16 are sent to the multiplexer 17 and the code of the pitch period, the code of the phonetic segment and the code of the duration are multiplexed to be a code stream which is in turn transferred onto the communication path from the output terminal 18. The above is the operation on the encoding side (transmission side).

On the decoding side (reception side), the code stream input from an input terminal 19 is broken down by the demultiplexer 20 to the code of the pitch period, the code of the phonetic segment and the code of the duration, which are in turn sent to the decoders 21, 22 and 23, respectively. The decoders 21 to 23 decode the received codes of the pitch period, phonetic segment and duration to restore original data, which are then sent to the synthesizer 24. The synthesizer 24 acquires a speech signal using the data on the pitch period, phonetic segment and duration.

As the synthesis method in the synthesizer 24, various schemes can be used depending on a combination of the selection of a synthesis unit and the selection of parameters used in this synthesis, as introduced in "Sound Communication Engineering" by Nobuhiko Kitawaki, Corona Publishing Co., Ltd. It is to be noted that this embodiment uses a synthesizer of an analysis-synthesis system disclosed in Jpn. Pat. Appln. KOKOKU Publication No. Sho 59-14752 as an example of a system which treats phonetic segments as synthesis units.

Figure 4:
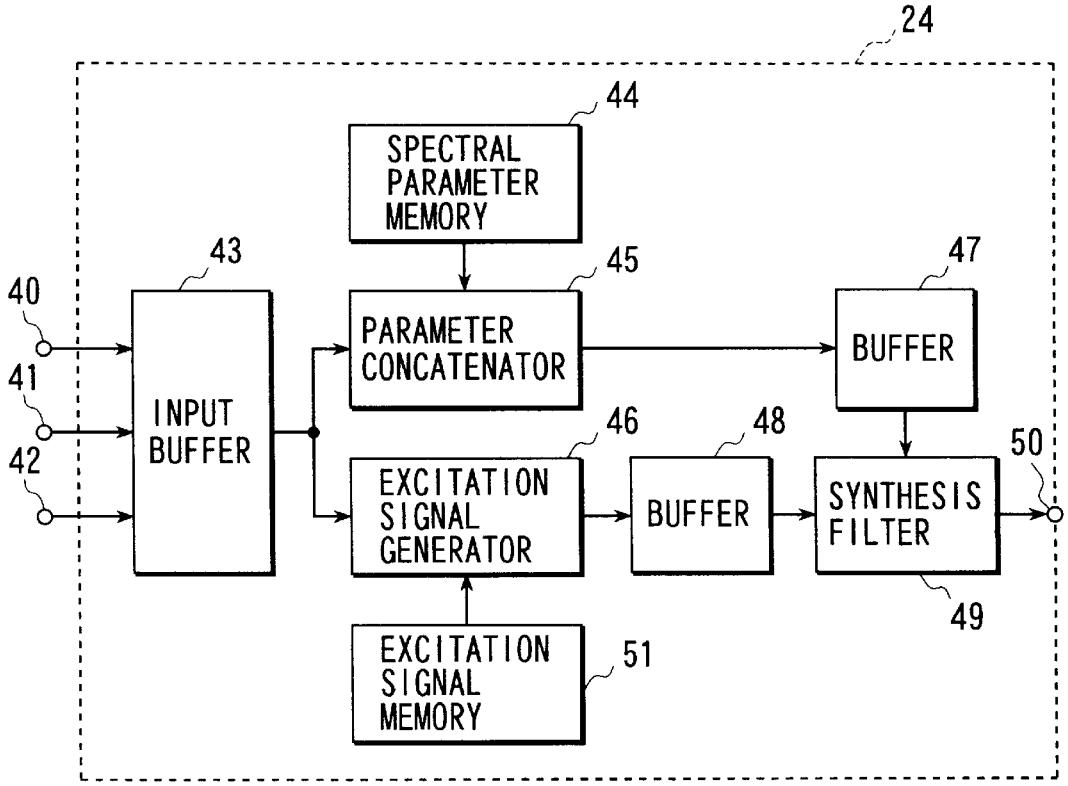
FIG. 4 is a block diagram of a synthesizer in FIG. 1.

FIG. 4 shows the structure of the synthesizer 24 of this system. First, data of the pitch period, phonetic segment and duration are input from input terminals 40, 41 and 42, and are written in an input buffer 43. A parameter concatenator 45 reads a phonetic code stream from the input buffer 43, reads spectral parameters corresponding to individual phonetic segments from a spectral parameter memory 44 and connects them as a word or a sentence, and then sends it to a buffer 47. Phonetic segments as synthesis units have previously been stored in the spectral parameter memory 44 in the form of spectral parameters like PARCOR, LSP or formant.

An excitation signal generator 46 reads the code stream of the pitch period, phonetic segment and duration from the input buffer 43, reads an excitation signal from an excitation signal memory 51 based on those data, and processes this excitation signal based on the pitch period and duration, thereby generating an excitation signal for a synthesis filter 49. Stored in the excitation signal memory 51 is an excitation signal which has been extracted from a residual signal obtained by linear prediction analysis on individual phonetic segment signals in actual speech data.

The process of generating the excitation signal in the excitation signal generator 46 differs depending on whether a phonetic segment to be synthesized is a voiced speech or an unvoiced speech. When a phonetic segment to be synthesized is a voiced speech, the excitation signal is generated by subjecting the excitation signal to duplicating or eliminating every pitch period read from the input buffer 43 until the excitation signal has a length equal to the duration read from the input buffer 43. When a phonetic segment to be synthesized is an unvoiced speech, the excitation signal read from the excitation signal memory 51 is used directly, or is processed such as partially cut or repeated, until the length of the excitation signal is equal to the duration read from the input buffer 43.

Last, the synthesis filter 49 reads the spectral parameters written in the buffer 37 and the excitation signal written in the buffer 48, synthesizes them based on a speech synthesis model to acquire a speech signal which is then sent to the output terminal 25 in FIG. 1 from an output terminal 50.

Figure 5:
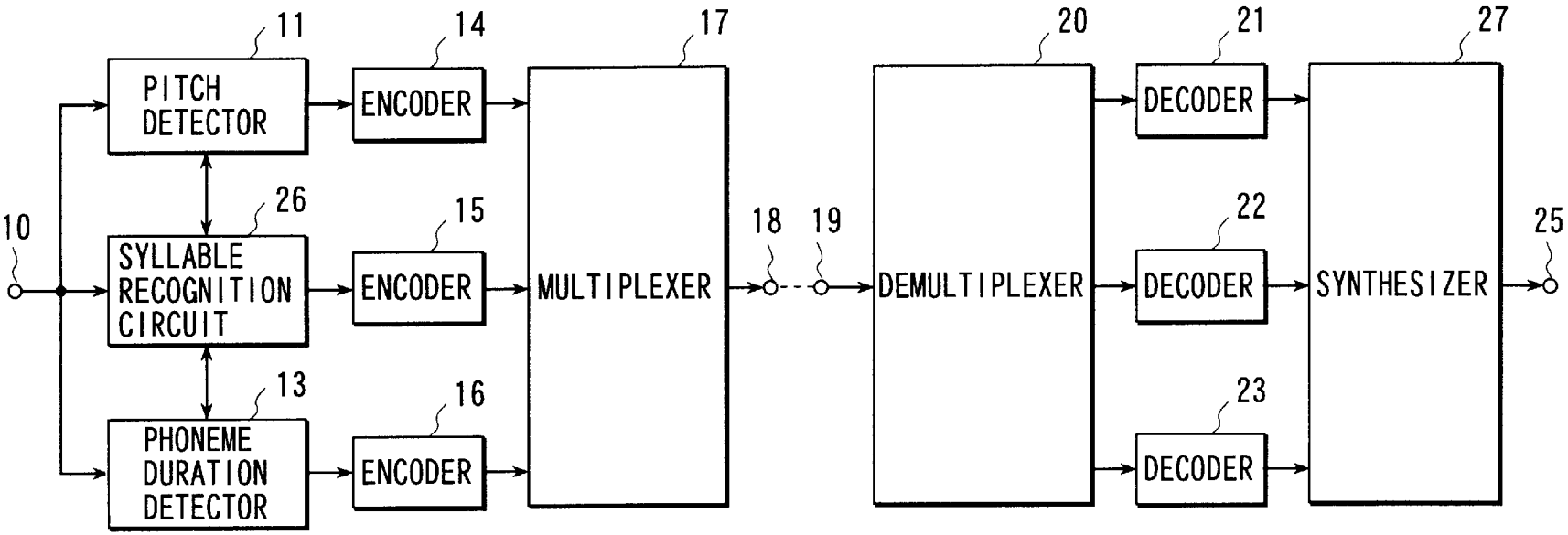
FIG. 5 is a block diagram of a speech encoding/decoding system according to a second embodiment of this invention.

FIG. 5 shows the structure of a speech encoding/decoding system which employs a speech recognition synthesis based encoding/decoding method according to a second embodiment of this invention. While the first embodiment recognizes phonetic segments which are treated as synthesis units, the second embodiment treats syllables as synthesis units.

The structure in FIG. 5 is fundamentally the same as the structure in FIG. 1 except for a syllable recognition circuit 26 and a synthesizer 27. Although there are various units for syllables to be synthesized and various syllable recognition schemes, the synthesis units are exemplified as CV and VC syllables and the following scheme is used as the syllable recognition method. Note that C represents a consonant and V a vowel.

Figure 6:
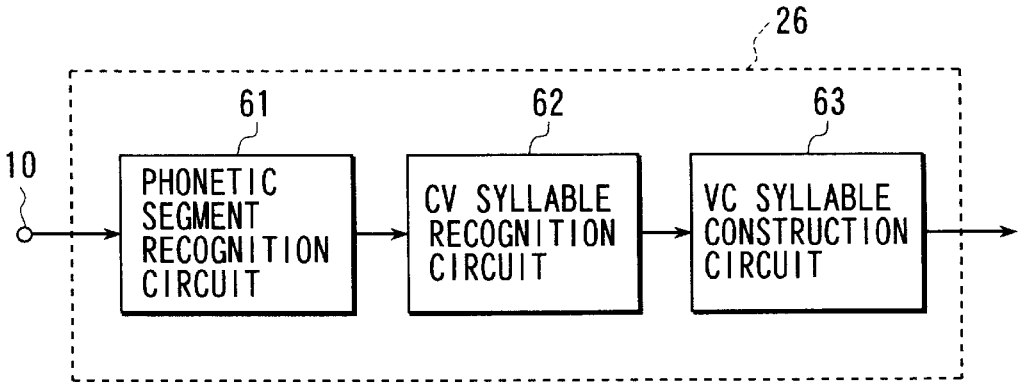
FIG. 6 is a block diagram of a syllable recognition circuit in FIG. 5.

FIG. 6 shows the structure of the syllable recognition circuit 26 with CV and VC syllables as units. A phonetic segment recognition circuit 61, which works the same way as the aforementioned phonetic segment recognition circuit 12, outputs a phonetic segment recognized for each frame upon reception of a speech signal. A recognition circuit 62 which treats CV syllables as units recognizes a CV syllable from the phonetic segment stream output from the phonetic segment recognition circuit 61 and outputs the CV syllable. A VC syllable construction circuit 63 constructs a VC syllable from the CV syllable stream output from the CV syllable recognition circuit 62, combines it with the input, and outputs the result.

Figure 7:
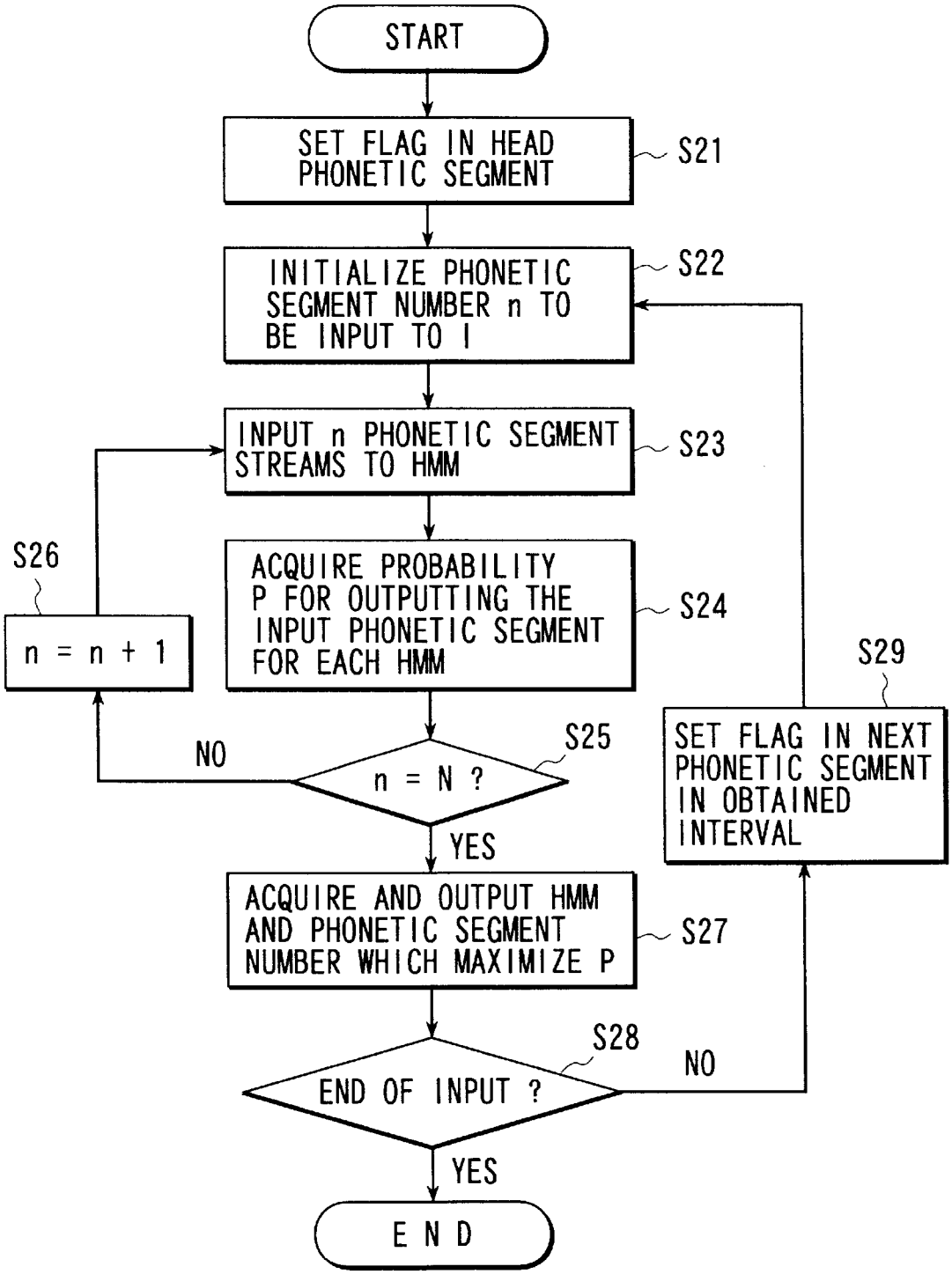
FIG. 7 is a flowchart illustrating a sequence of processes executed by a CV syllable recognition circuit in FIG. 6.

The procedures of syllable recognition by the CV syllable recognition circuit 62 will be exemplified with reference to the flowchart in FIG. 7.

First, a flag is set to the top phonetic segment in the input speech data in step S21. In step S22, a phonetic segment number n to be input to the phonetic segment recognition circuit 61 is initialized to a predetermined number I. In step S23, actual n consecutive phonetic segments are subjected to a discrete HMM (Hidden Markov Model) which deals with phonetic segments previously prepared for each CV syllable as output symbols. In step S24, the probability p that the stream of the input phonetic segments is obtained by the HMM is obtained for each of a plurality of Hidden Markov Models (HHMs). In step S25, it is determined if n has reached the predetermined upper limit N of the number of input phonetic segments. When n has not reached N, the phonetic segment number n to be input is set to n=n+1 in step S26, and then the process is repeated from step 23. When n has reached N, the flow proceeds to step S27 where a CV syllable and the phonetic segment number n which correspond to the HMM that maximizes the probability p are acquired first. Then, it is determined that the interval of the acquired number of phonetic segments counting from the frame corresponding to the flag-set phonetic segment is an interval corresponding to the CV syllable, and the interval is output together with the acquired CV syllable. In step S28, it is determined if inputting of phonetic segments is completed. If such inputting is not finished yet, a flag is set to the next phonetic segment in the interval output in step S29, and the flow returns to step S22 to repeat the above-discussed operation.

Next, the VC syllable construction circuit 63 will be discussed.

The VC syllable construction circuit 63 receives the CV syllable and the interval corresponding to the syllable, which have been output by the above scheme. The VC syllable construction circuit 63 has a memory where a method of constructing a VC syllable from two CV syllables has been described in advance, and reconstructs the input syllable stream to a VC syllable stream according to what is written in the memory. One possible way of constructing a VC syllable from two CV syllables is to determine an interval from the center frame of the first CV syllable to the center frame of the next frame as a VC syllable which consists of the vowel of the first CV syllable and the consonant of the next CV syllable.

Figure 8:
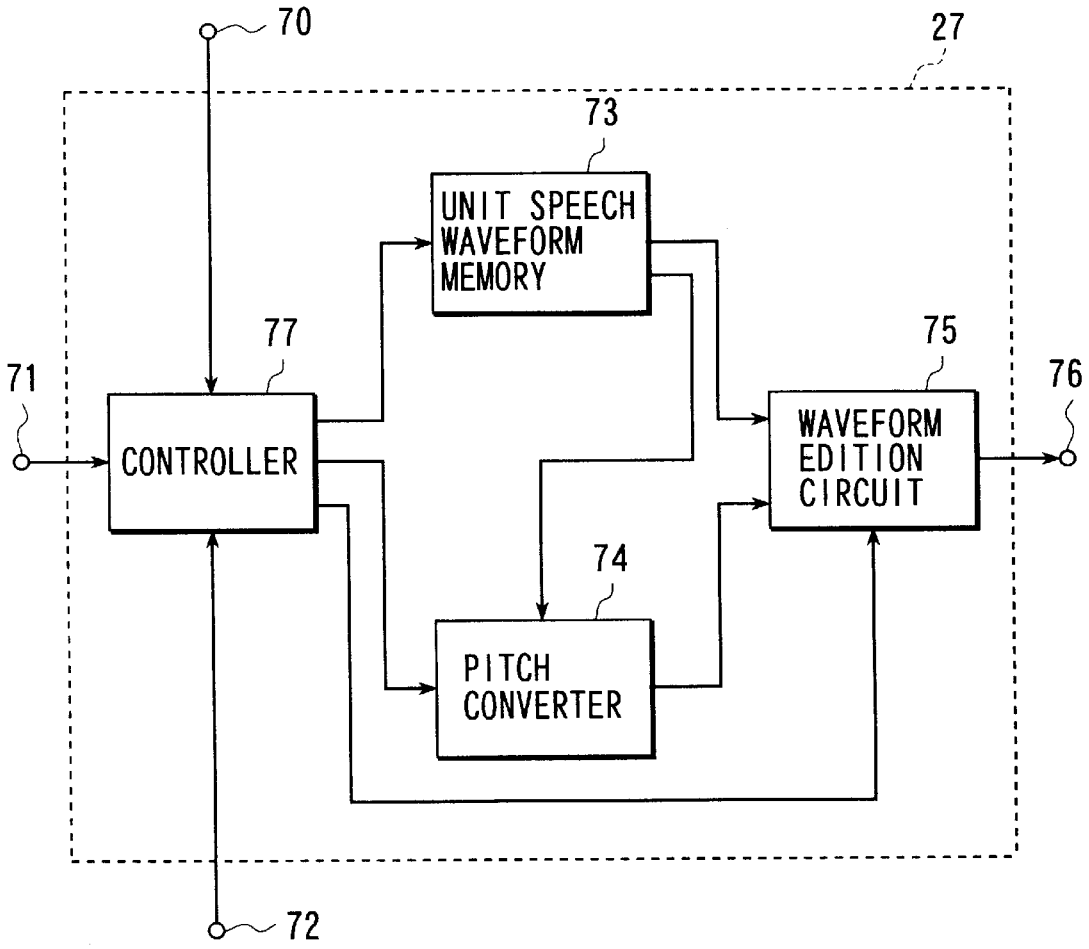
FIG. 8 is a block diagram of another synthesizer to be used in this invention.

As another example of the synthesizer which treats syllables as synthesis units, a waveform edition type speech synthesizing apparatus as disclosed in Jpn. Pat. Appln. KOKOKU Publication No. Sho 58-134697. FIG. 8 shows the structure of such a synthesizer 27.

In FIG. 8, a controller 77 receives a data stream of the pitch period, syllable and duration via input terminals 70, 71 and 72, informs a unit speech waveform memory 73 of the transfer destination for syllable data and a unit speech waveform stored in the memory 73, sends the pitch period to a pitch modification circuit 74 and the duration to a waveform edition circuit 75. The controller 77 instructs to transfer the syllable to be synthesized to the pitch modification circuit 74 when this syllable is a voiced part and its pitch needs to be converted, and instructs to transfer the syllable to the waveform edition circuit 75 when the syllable is an unvoiced part.

The unit speech waveform memory 73 retains speech waveforms of CV and VC syllables as synthesis units, which are extracted from actual speech data, and sends out a corresponding unit speech waveform to the pitch modification circuit 74 or the waveform edition circuit 75 in accordance with the input syllable data and the instruction from the controller 77. When the pitch should be modified, the controller 77 sends the pitch period to the pitch modification circuit 74 where the pitch period is modified. The modification of the pitch period is accomplished by a known method like the waveform superposition scheme.

The waveform edition circuit 75 interpolates or thins the speech waveform sent from the pitch modification circuit 74 when the instruction from the controller 77 indicates that the pitch should be modified, and interpolates or thins the speech waveform sent from the unit speech waveform memory 73 when the pitch need not be modified, so that the pitch becomes equal to the input duration, thereby generating a speech waveform for each syllable. Further, the waveform edition circuit 75 combines the speech waveforms of the individual syllables to generate a speech signal.

As the synthesizer 27 in FIG. 8 performs synthesis by recognizing a speech signal syllable by syllable as apparent from the above, it has an advantages over the synthesizer 24 shown in FIG. 4 in that a synthesized speech of a higher sound quality is acquired. Specifically, when phonetic segments are treated as synthesis units, there are multiple connections between synthesis units and the synthesis units are connected even at locations where the speech parameters change drastically such as where connection from a consonant to a vowel is made. This makes it difficult to obtain high-quality synthesized speeches. As the recognition unit becomes longer, the recognition efficiency is improved, thus improving the sound quality of synthesized speeches.

In view of the aforementioned advantages of the synthesizer 27 in FIG. 8, words longer than syllables may be used as synthesis units to further improve the speech quality. When synthesis units go up to the level of words, however, the number of codes for identifying a word is increased, resulting in a higher bit rate. A possible compromise proposal for improving the recognition efficiency to enhance the speech quality is to recognize input speech data word by word and perform synthesis syllable by syllable.

Figure 9:
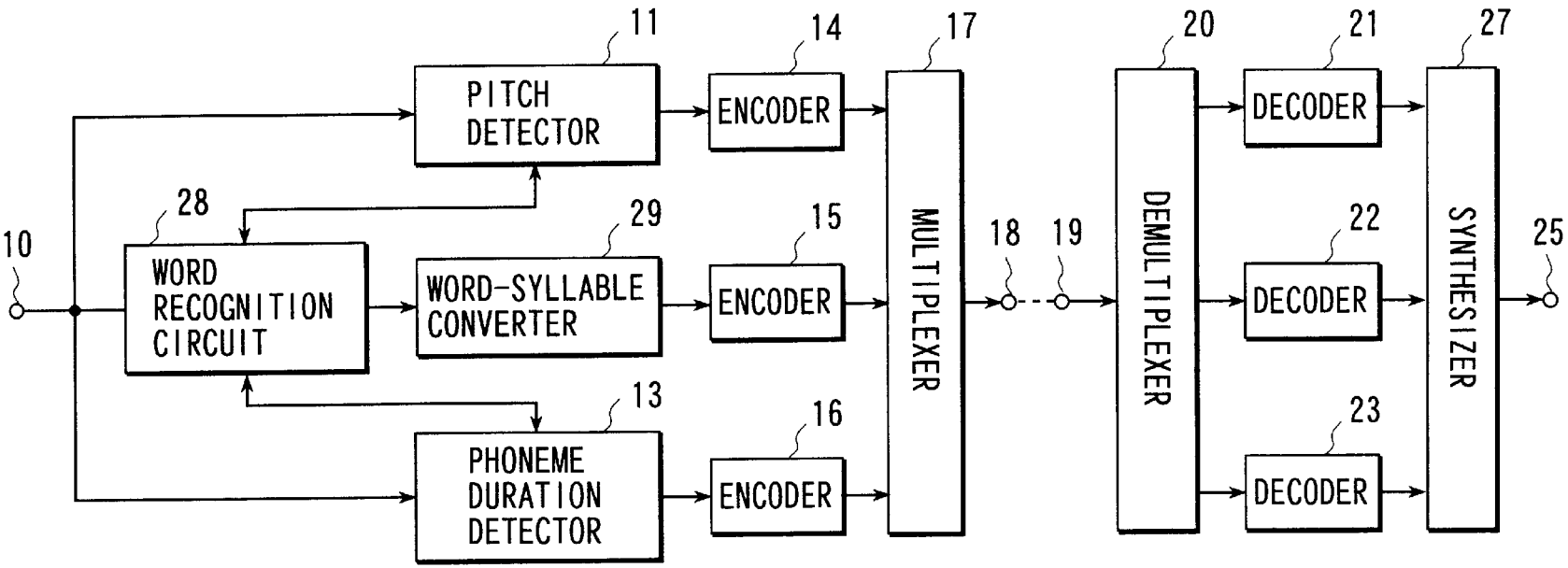
FIG. 9 is a block diagram of a speech encoding/decoding system according to a third embodiment of this invention.

FIG. 9 is a block diagram of a speech encoding/decoding system according to a third embodiment of this invention which is designed on the basis of this proposed scheme. The third embodiment differs from the first and second embodiments in that the phonetic segment recognition circuit 12 in FIG. 1 or the syllable recognition circuit 26 in FIG. 5 is replaced with a word recognition circuit 28 and a word-syllable converter 29 which converts a recognized word to a syllable. This structure can improve the recognition efficiency to enhance the speech quality without increasing the number of codes.

The above-described first, second and third embodiments are designed to use one kind of a previously prepared spectral parameter and excitation signal or unit speech waveform for use in the synthesizer although they extract and transfer information for prosody generation like the pitch period and duration from the input speech data. Though speaker's information for prosody generation such as intonation, a rhythm and tone are reproduced on the decoding side, the quality of reproduced voices is determined by the previously prepared spectral parameter and excitation signal or unit speech signal, and speeches are always reproduced with the same voice quality irrespective of speakers. For richer communications, a system capable of reproducing multifarious voice qualities is desirable.

To meet this demand, a fourth embodiment is equipped with a plurality of synthesis unit codebooks for use in the synthesizer. Here the spectral parameter and excitation signal or unit speech waveform are called synthesis unit codebooks.

Figure 10:
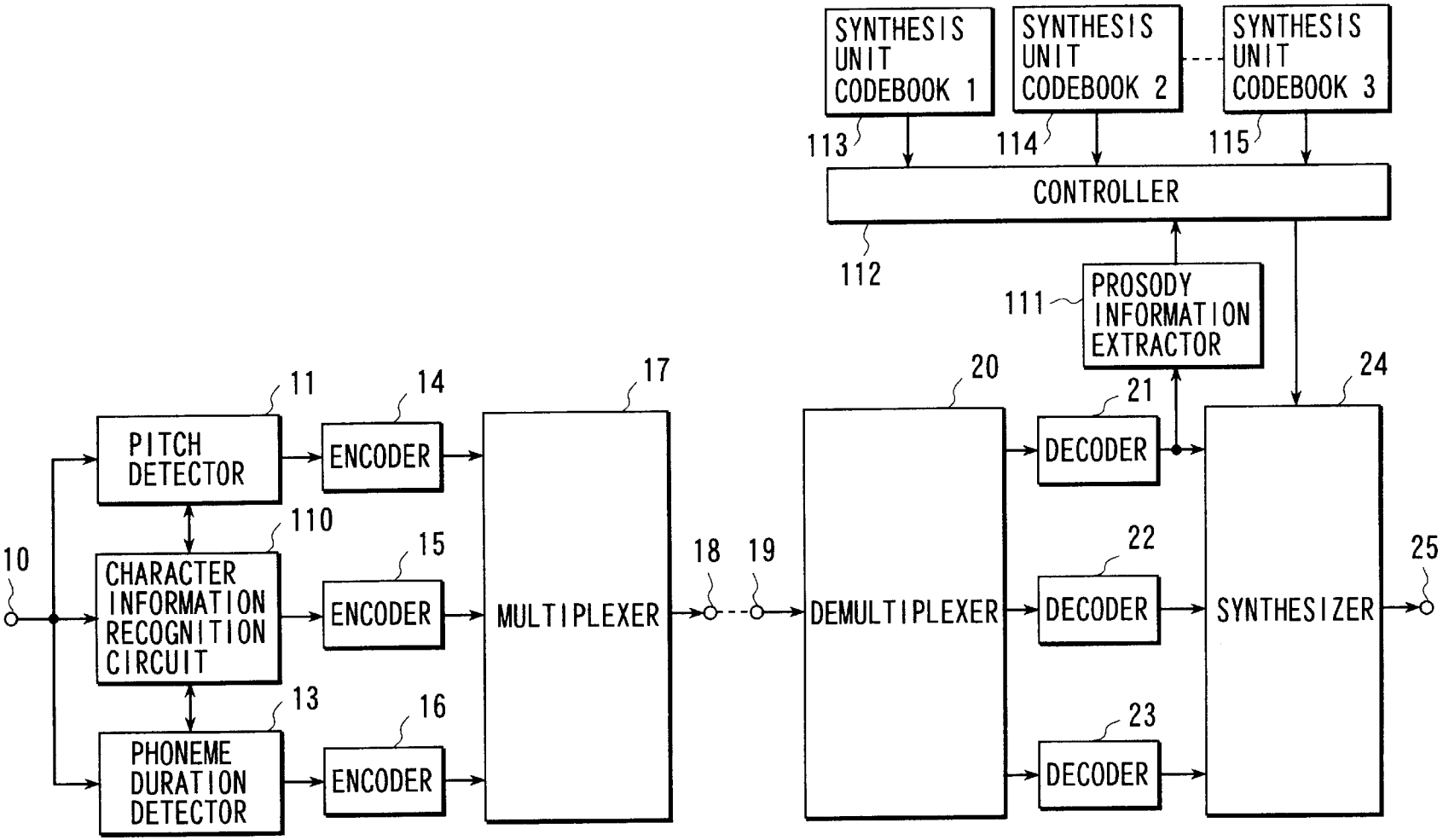
FIG. 10 is a block diagram of a speech encoding/decoding system according to a fourth embodiment of this invention.

FIG. 10 presents a block diagram of a speech encoding/decoding system according to the fourth embodiment of this invention which is equipped with a plurality of synthesis unit codebooks. The basic structure of this embodiment is the same as those of the first, second and third embodiments that have been discussed with reference to FIGS. 1, 5 and 9, and differs in the latter embodiments in that a plurality of (N) synthesis unit codebooks 113, 114 and 115 are provided on the encoding side, and one synthesis unit codebook for use in synthesis is selected in accordance with the transferred information of the pitch period.

In FIG. 10, a character information recognition circuit 110 on the encoding side is equivalent to the phonetic segment recognition circuit 12 shown in FIG. 1, the syllable recognition circuit 26 shown in FIG. 5, or the word recognition circuit 28 and word-syllable converter 29 shown in FIG. 9.

The decoder 21 on the decoding side decodes the transferred pitch period and sends it to a prosody information extractor 111. The prosody information extractor 111 stores the input pitch period and extracts information for prosody generation, such as the mean pitch period or the maximum or minimum value of the pitch period from a stream of the stored pitch periods.

The synthesis unit codebooks 113, 114 and 115 retain spectral parameters and excitation signals or unit speech waveforms prepared from speech data of different speakers, and information for prosody generation, such as mean pitch periods or the maximum or minimum values of the pitch periods extracted from the respective speech data.

A controller 112 receives information for prosody generation, such as the mean pitch period or the maximum or minimum value of the pitch period from the prosody information extractor 111, computes a difference or error between this information for prosody generation and the information for prosody generation stored in the synthesis unit codebooks 113, 114 and 115, selects the synthesis unit codebook which minimizes the error and transfers the codebook to the synthesizer 24. Note that an error in information for prosody generation is acquired by, for example, computing a weight-added average of squares of errors in the mean pitch period, the maximum value and the minimum value.

The synthesizer 24 receives data of the pitch period, the phonetic segment or syllable and the duration from the decoders 21, 22 and 23, respectively, and produces a synthesized speech by using those data and the synthesis unit codebook transferred from the controller 112.

This structure permits reproduction of a synthesized speech of a vocal tone similar to that of the speaker that has been input on the encoding side, and thus facilitates identification of the speaker, ensuring more affluent communications.

Figure 11:
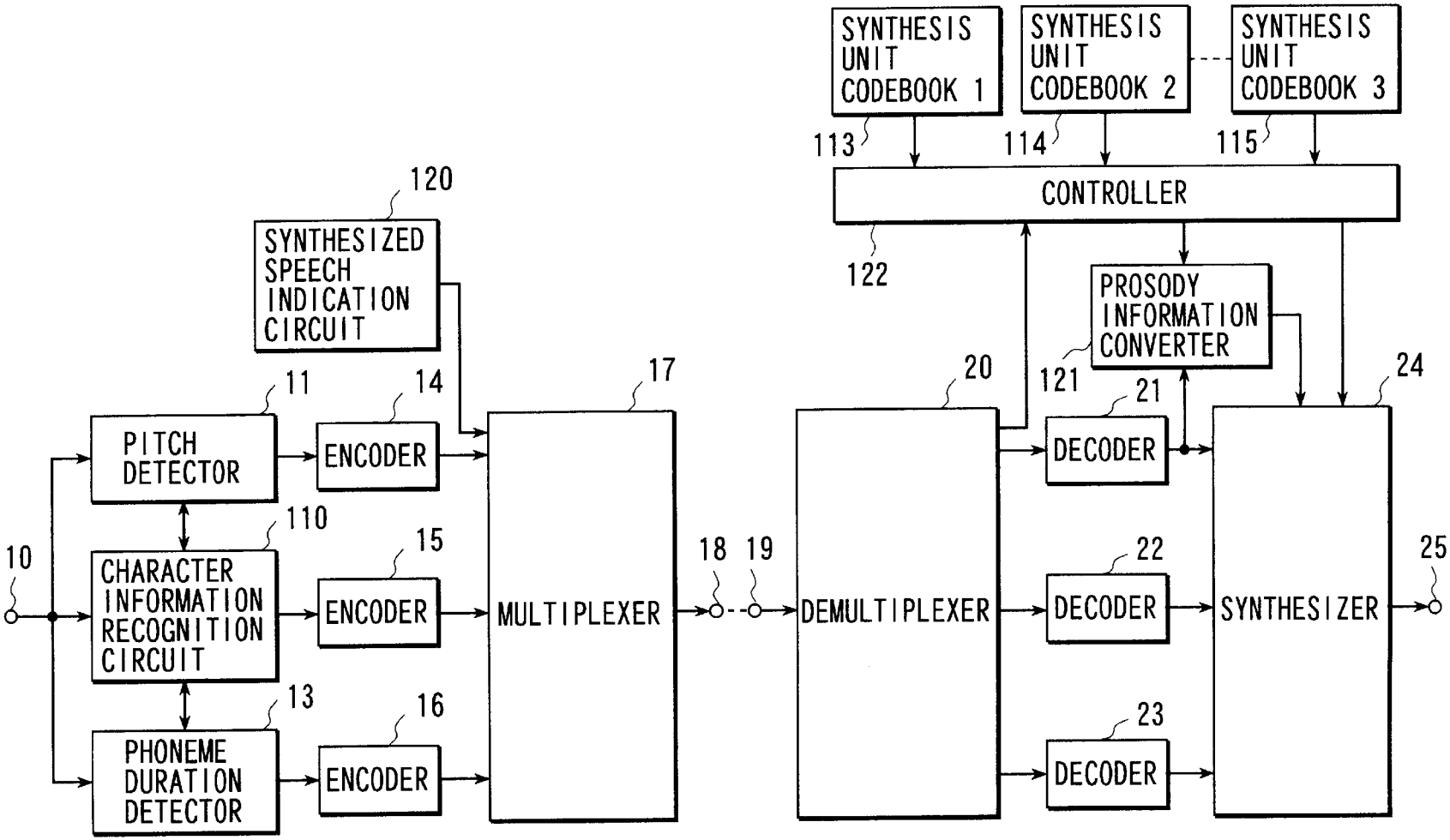
FIG. 11 is a block diagram of a speech encoding/decoding system according to a fifth embodiment of this invention.

FIG. 11 shows the structure of a speech encoding/decoding system according to a fifth embodiment of this invention as another example equipped with a plurality of synthesis unit codebooks. This embodiment has a plurality of synthesis unit codebooks on the decoding side and a synthesized speech indication circuit on the encoding side, which indicates the type of a synthesized speech.

Referring to FIG. 11, a synthesized speech indication circuit 120 provided on the encoding side presents a speaker with information about the synthesis unit codebooks 113, 114 and 115, prepared on the decoding side, to allow the speaker to select which synthesized speech to use, receives synthesized speech select information indicating the type of the synthesized speech via an input device like a keyboard, and sends the information to the multiplexer 17. The information to be presented to the speaker consists of information in the speech data used to prepared the synthesis unit codebooks, which represent the voice properties, such as the sex, age, deep voice, and faint voice.

The synthesized speech select information transferred to the decoding side via the communication path from the multiplexer 17 is sent to a controller 122 via the demultiplexer 20. The controller 122 selects one synthesis unit codebook to use in synthesis from the synthesis unit codebooks 113, 114 and 115 and transfers it to the synthesizer 24, and simultaneously sends information for prosody generation, such as the mean pitch period or the maximum or minimum value of the pitch period, stored in the selected synthesis unit codebook, to a prosody information converter 121.

The prosody information converter 121 receives the pitch period from the decoder 21 and the information for prosody generation in the synthesis unit codebook from the controller 122, converts the pitch period in such a manner that the rhythm, such as the mean pitch period or the maximum or minimum value of the input pitch period, approaches the information for prosody generation in the synthesis unit codebook, and gives the result to the synthesizer 24. The synthesizer 24 receives data on the phonetic segment or syllable, the duration and the pitch period from the decoders 22 and 23 and the prosody information converter 121, and provides a synthesized speech by using those data and the synthesis unit codebook transferred from the controller 122.

This structure brings about an advantage, not presented by the conventional encoding device, which allows a sender or a user on the encoding side to select a synthesized speech to be reproduced on the encoding side according to the sender's preference, and also can easily accomplish transformation between various voice properties including conversion between male and female voice properties, e.g., reproduction of a mail voice in a female voice. The ability to provide multifarious synthesized sounds, such as the conversion of voice properties, is effective in making chat between unspecified persons on the Internet more entertaining and enjoyable.

Figure 12:
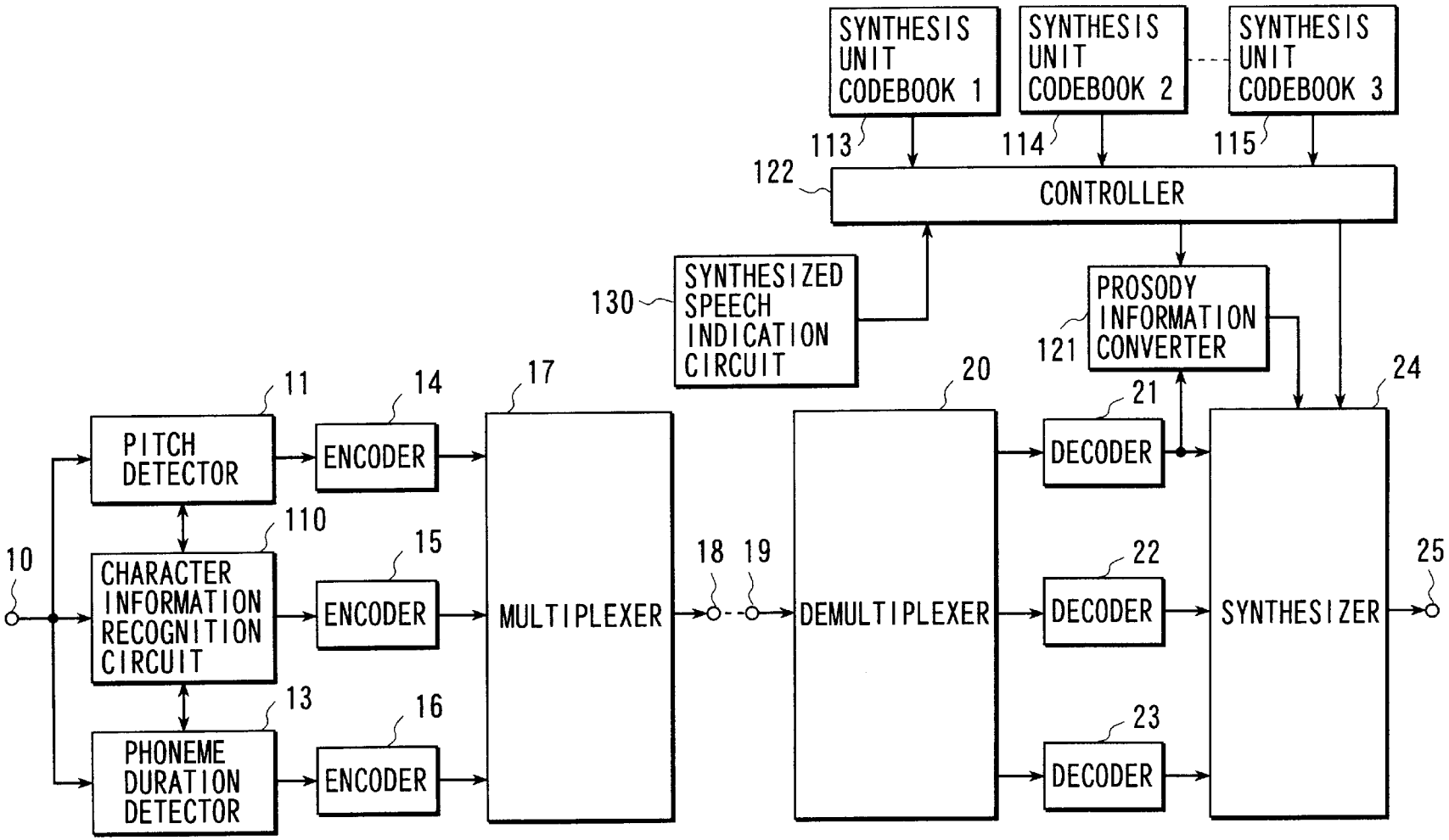
FIG. 12 is a block diagram of a speech encoding/decoding system according to a sixth embodiment of this invention.

FIG. 12 shows the structure of a speech encoding/decoding system according to a sixth embodiment of this invention. Although the fifth embodiment shown in FIG. 11 has the synthesized speech indication circuit 120 on the encoding side, such a synthesized speech indication circuit (130) may be provided on the decoding side as shown in FIG. 12. This design has an advantage such that a receiver or a user on the encoding side can select the voice property of a synthesized speech to be reproduced.

Figure 13:
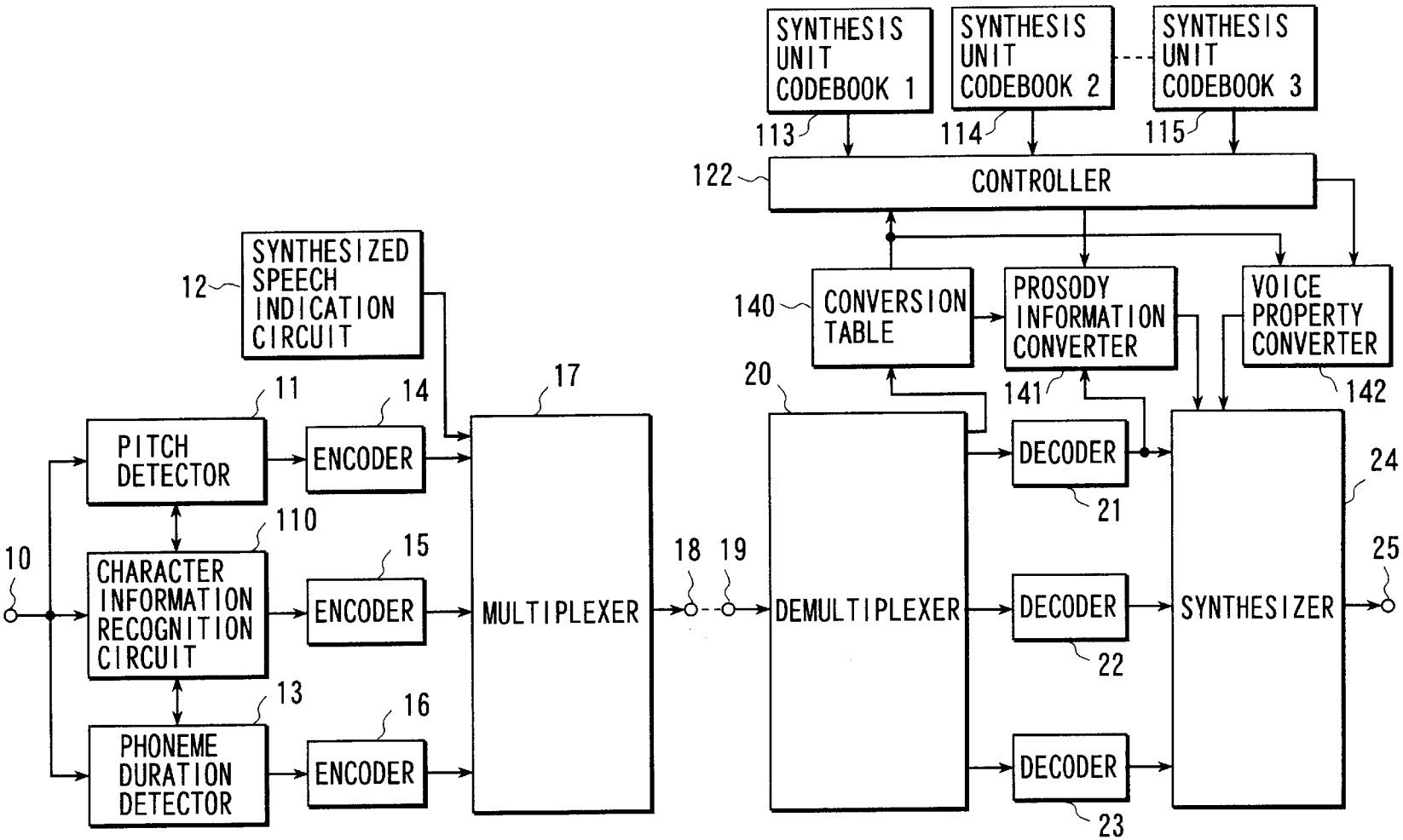
FIG. 13 is a block diagram of a speech encoding/decoding system according to a seventh embodiment of this invention.

FIG. 13 shows the structure of a speech encoding/decoding system according to a seventh embodiment of this invention. This embodiment is characterized in that a synthesized speech indication circuit 120 is provided on the encoding side as per the fifth embodiment shown in FIG. 11, so that information for prosody generation and the parameter of the synthesizer 24 can be converted based on an instruction from the synthesized speech indication circuit 120 on the decoding side to alter the intonation and voice properties of the synthesized speech according to the sender's preference.

In FIG. 13, the synthesized speech indication circuit 120 is provided on the encoding side selects a preferable voice from among classes representing the features of previously prepared voices, such as a robotic voice, an animation voice, an alien voice, in accordance with the sender's instruction, and sends a code representing the selected voice to the multiplexer 17 as synthesized speech select information.

The synthesized speech select information transferred from the encoding side via the communication path from the multiplexer 17 is sent to a conversion table 140 via the demultiplexer 20. The conversion table 140 previously stores intonation conversion parameters for converting the intonation of the synthesized speech and voice property conversion parameters for converting the voice property in association with the characteristic of the synthesized speech, such as a robotic voice, an animation voice, an alien voice. The conversion table 140 sends information on the intonation conversion parameter and voice property conversion parameter to the controller 122 and a prosody information converter 141 and a voice property converter 142 in accordance with synthesized sound indication information from the synthesized speech indication circuit 120 which has been input via the demultiplexer 20.

The controller 122 selects one synthesis unit codebook to use in synthesis from the synthesis unit codebooks 113, 114 and 115 based on the information from the synthesizer 24, and transfers it to the synthesizer 24, and at the same time sends the information for prosody generation, such as the mean pitch period or the maximum or minimum value of the pitch period, stored in the selected synthesis unit codebook to the prosody information converter 141.

The prosody information converter 141 receives the information for prosody generation in the synthesis unit codebook from the controller 122 and the information of the intonation conversion parameter from the conversion table 140, converts the information for prosody generation, such as the mean pitch period or the maximum or minimum value of the pitch period, and supplies the result to the synthesizer 24. The voice property converter 142 converts the excitation signal, spectral parameter and the like, stored in the synthesis unit codebook selected by the controller 122, to the synthesizer 24.

While the fifth embodiment illustrated in FIG. 11 actually limits the intonation of a synthesized speech and the type of a voice property by the type of a speech used in preparing the synthesis unit codebook 113, 114 or 115, the sixth embodiment ensures multi-farious rules for converting the information for prosody generation, excitation signal and spectral parameters, thus easily increasing the types of synthesized speeches.

Although the synthesized speech indication circuit 120 is provided on the encoding side in FIG. 13, it may be provided on the decoding side as in FIG. 12.

Although several embodiments of the present invention have been described herein, it should be apparent to those skilled in the art that the subject matter of the invention is such that character information, such as a phonetic segment, syllable or a word is recognized from an input speech signal, the information is transferred or stored, information for prosody generation like the pitch period or duration is detected and transferred or stored, all on the encoding side, and a speech signal is synthesized on the decoding side based on the transferred or stored character information like phonetic segment, syllable or word and the transferred or stored information for prosody generation like the pitch period and duration, and that this invention may be embodied in many other specific forms without departing from the spirit or scope of the invention. Further, the recognition scheme, the pitch detection scheme, the duration detection scheme, the schemes of encoding and decoding the transferred information, the system of the speech synthesizer, etc. are not restricted to those illustrated in the embodiments of the invention, but various other known methods and systems can be adapted.

In short, according to this invention, not only character information, such as a phonetic segment or a syllable is recognized from an input speech signal and is transferred or stored, but also information for prosody generation like the pitch period or duration is detected and transferred or stored, and a speech signal is synthesized based on the transferred or stored character information like phonetic segment or a syllable and the transferred or stored information for prosody generation like the pitch period and duration. It is therefore possible to exhibit outstanding effects, not presented by the prior art, of reproducing the intonation, rhythm and tone of a speaker and transferring speaker's emotion and feeling, in addition to the ability to encode a speech signal at a very low rate of 1 kbps or lower based on the recognition-synthesis scheme.

Furthermore, if a plurality of synthesis unit codebooks are provided for spectral parameters and excitation signals or unit speech waveforms for use in synthesis and a specific synthesis unit codebook is selectable according to a user's instruction, various advantages, such as easily identifying the speaker, implementing multifarious synthesized speeches desirable by users, realizing voice property conversion, are brought about. This makes communications more entertaining and enjoyable.

Additional advantages and modifications will readily occurs to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed as new and desired to be secured by Letters Patent of the United States is:

1. A speech recognition synthesis based encoding/decoding method comprising the steps of:

recognizing character information from an input speech signal;

detecting first prosody information from said input speech signal;

encoding said character information and said first prosody information to acquire code data;

transferring or storing the code data;

decoding said transferred or stored code data to said character information and said first prosody information;

selecting a synthesis unit codebook from a plurality of synthesis unit codebooks in accordance with one of said first prosody information and a specified type of a synthesized speech, the plurality of synthesis unit codebooks storing second prosody information prepared from speech data of different speakers, the selecting step including computing error between the first prosody information and the second prosody information and selecting from said synthesis unit codebooks a synthesis unit codebook which minimizes the error; and synthesizing a speech signal using said character information and the selected said synthesis unit codebook.

2. The speech recognition synthesis based encoding/decoding method according to claim 1, wherein said recognizing step includes dividing said input speech signal into analysis frames, acquiring a feature vector for each of the analysis frames, and computing a similarity between said feature vector for each of the analysis frames and a feature template vector previously prepared for each phonetic segment to determine a phonetic segment of each of the analysis frames which is used to recognize the character information.

3. The speech recognition synthesis based encoding/decoding method according to claim 2, wherein said similarity computing step includes computing a Euclidean distance based on said feature vector and said feature template vector to determine a phonetic segment which minimizes said Euclidean distance as a phonetic segment of said synthesis frame.

4. The speech recognition synthesis based encoding/decoding method according to claim 2, further comprising the steps of determining if said input speech signal is a voiced speech or a unvoiced speech and detecting a pitch period of said input speech signal when determined as a voiced speech, and detecting a duration of said phonetic segment recognized by said recognizing step.

5. The speech recognition synthesis based encoding/decoding method according to claim 1, wherein said recognizing step includes dividing said input speech signal into analysis frames, acquiring a feature vector for each of the analysis frames, and computing an incidence of the feature vector relative to HMM (Hidden Markov Model) previously prepared for each phonetic segment to determine a phonetic segment of each of the analysis frames which is used to recognize the character information.

6. The method according to claim 1, wherein said transferring/storing step includes the step of transferring or storing select information indicating the specified type of a synthesized speech.

7. The method according to claim 6, which includes the step of altering intonation and voice properties of the synthesized speech in accordance with the select information.

8. The method according to claim 1, wherein said selecting step includes the step of generating select information indicating the specified type of a synthesized speech to select the one of said synthesis unit codebooks in accordance with the select information.

9. A speech recognition synthesis based encoding/decoding method comprising the steps of:

recognizing phonetic segments, syllables or words as character information from an input speech signal;

detecting pitch periods and durations of said phonetic segments or syllables, as first prosody information, from said input speech signal;

encoding said character information and said first prosody information to obtain code data;

transferring or storing said code data;

decoding said transferred or stored code data to said character information and said first prosody information;

selecting a synthesis unit codebook from a plurality of synthesis unit codebooks in accordance with one of said first prosody information and a specified type of a synthesized speech, the plurality of synthesis unit codebooks storing second prosody information prepared from speech data of different speakers, the selecting step including computing error between the first prosody information and the second prosody information and selecting from said synthesis unit codebooks a synthesis unit codebook which minimizes the error; and synthesizing a speech signal using said character information and the selected synthesis unit codebook.

10. The speech recognition synthesis based encoding/decoding method according to claim 9, wherein said recognizing step includes dividing said input speech signal into analysis frames, acquiring a feature vector for each of the analysis frames, and computing a similarity between said feature vector for each of the analysis frames and a feature template vector previously prepared for each phonetic segment to determine a phonetic segment of said each synthesis frame which is used to recognize the character information.

11. The speech recognition synthesis based encoding/decoding method according to claim 10, wherein said similarity computing step includes computing a Euclidean distance based on said feature vector and said feature template vector to determine a phonetic segment which minimizes said Euclidean distance as a phonetic segment of said analysis frames.

12. The speech recognition synthesis based encoding/decoding method according to claim 10, further comprising the steps of determining if said input speech signal is a voiced speech or a unvoiced speech to detect a pitch period of said input speech signal when determined as a voiced speech, and detecting a duration of a phonetic segment recognized by said recognizing and detecting step.

13. The speech recognition synthesis based encoding/decoding method according to claim 10, wherein said synthesizing step includes coupling spectral parameters corresponding to individual phonetic segments as a word or a sentence, processing an excitation signal based on a data stream including said phonetic segments, pitch periods and durations in accordance with said pitch period and said durations to generate an excitation signal for a synthesis filter, and processing said spectral parameters and said excitation signal in accordance with a speech synthesis model to produce a synthesized speech signal.

14. The speech recognition synthesis based encoding/decoding method according to claim 9, wherein said recognizing step includes dividing said input speech signal into analysis frames, acquiring a feature vector for each of the analysis frames, and computing an incidence of the feature vector relative to HMM (Hidden Markov Model) previously prepared for each phonetic segment to determine a phonetic segment of each of the analysis frames which is used to recognize the character information.

15. The method according to claim 9, wherein said transferring/storing step includes the step of transferring or storing select information indicating the specified type of a synthesized speech.

16. The method according to claim 15, which includes the step of altering intonation and voice properties of the synthesized speech in accordance with the select information.

17. The method according to claim 9, wherein said selecting step includes the step of generating select information indicating the specified type of a synthesized speech to select the one of said synthesis unit codebooks in accordance with the select information.

18. A speech encoding/decoding system comprising:

a recognition section configured to recognize character information from an input speech signal;

a detection section configured to detect first prosody information from said input speech signal;

an encoding section configured to encode said character information and said first prosody information to code data;

a transfer/storage section configured to transfer or store said code data acquired by said encoding section;

a decoding section configured to decode said transferred or stored code data to said character information and said first prosody information;

a plurality of synthesis unit codebooks storing second prosody information prepared from speech data of different speakers;

a controller configured to select one of said synthesis unit codebooks in accordance with one of said first prosody information and a specified type of a synthesized speech by computing error between the first prosody information and the second prosody information and selecting from said synthesis unit codebooks a synthesis unit codebook which minimizes the error; and a synthesis section configured to synthesize a speech signal using said character information and the selected one of said synthesis unit codebooks.

19. The speech encoding/decoding system according to claim 18, wherein said recognition section includes an analysis frame generation section configured to divide said input speech signal into analysis frames, a feature extraction section configured to acquire a feature vector for each of the analysis frames, and a phonetic segment determination section configured to compute a similarity between said feature vector for each of the analysis frames and a feature template vector previously prepared for each phonetic segment to determine a phonetic segment of each of the analysis frames which is used to recognize the character information.

20. The speech encoding/decoding system according to claim 19, wherein said phonetic segment determination section computes a Euclidean distance based on said feature vector and said feature template vector and determines a phonetic segment which minimizes said Euclidean distance as a phonetic segment of said analysis frames.

21. The speech encoding/decoding system according to claim 19, wherein said detection section includes a pitch detector configured to determine if said input speech signal is a voiced speech or a unvoiced speech and detecting a pitch period of said input speech signal when determined as a voiced speech, and a duration detector configured to detect a duration of a phonetic segment recognized by said recognition section.

22. The speech encoding/decoding system according to claim 18, wherein said recognition section includes an analysis frame generation section configured to divide said input speech signal into analysis frames, a feature extraction section configured to acquire a feature vector for each of the analysis frames, and a phonetic segment determination section configured to compute an incidence of the feature vector relative to HMM (Hidden Markov Model) previously prepared fore each phonetic segment to determine a phonetic segment of each of the analysis frames.

23. The system according to claim 18, wherein said transfer/storage section is configured to generate and transfer or store select information indicating the specified type of a synthesized speech.

24. The system according to claim 23, which includes an altering section configured to alter intonation and voice properties of the synthesized speech in accordance with the select information.

25. The system according to claim 18, wherein said controller is configured to generate and transfer or store select information indicating the specified type of a synthesized speech to select the one of said synthesis unit codebooks in accordance with the select information.

26. A speech recognition synthesis based encoding method comprising the steps of:

recognizing character information from an input speech signal;

detecting prosody information from said input speech signal;

generating select information indicating a type of a synthesized speech to be produced by a decoder based upon an error between the prosody information and stored prosody generation information;

encoding said character information and said prosody information to acquire code data; and transferring or storing the code data and the select information.

* * * * *